United States Patent [19]

Kicherer et al.

[11] Patent Number: 4,754,123

[45] Date of Patent: Jun. 28, 1988

[54] ELECTRIC HOTPLATE

[75] Inventors: Robert Kicherer; Felix Schreder, both of Oberderdingen, Fed. Rep. of Germany

[73] Assignee: E.G.O. Elektro-Gerate Blanc u. Fischer, Fed. Rep. of Germany

[21] Appl. No.: 19,695

[22] Filed: Feb. 27, 1987

[30] Foreign Application Priority Data

Mar. 1, 1986 [DE] Fed. Rep. of Germany ..... 3606794

[51] Int. Cl.[4] ..... H05B 3/70

[52] U.S. Cl. ..... 219/449; 219/457; 219/443

[58] Field of Search ..... 219/449, 443, 448, 451, 219/452, 457, 458, 459, 460, 461, 462, 463, 464, 465, 467, 512; 337/390, 391, 394

[56] References Cited

U.S. PATENT DOCUMENTS

| | | | |
|---|---|---|---|
| 4,135,081 | 1/1979 | Fischer | 219/449 |
| 4,605,841 | 8/1986 | Fischer | 219/449 |
| 4,633,238 | 12/1986 | Goessler | 219/449 |

FOREIGN PATENT DOCUMENTS

| | | | |
|---|---|---|---|
| 2422623 | 4/1977 | Fed. Rep. of Germany . | |
| 2901801 | 7/1980 | Fed. Rep. of Germany . | |
| 3,124,776 | 9/1982 | Fed. Rep. of Germany . | |
| 3301689 | 1/1983 | Fed. Rep. of Germany . | |
| 2369674 | 5/1978 | France | 337/394 |

*Primary Examiner*—E. A. Goldberg
*Assistant Examiner*—Teresa J. Walberg
*Attorney, Agent, or Firm*—Steele, Gould & Fried

[57] ABSTRACT

In an electric hotplate (1), the casing (15) of a thermal cutout (14) integrated with a projecting expansion rod temperature sensor (16) is open or unclosed on the top side, so that its reception depth for receiving the associated limiter switch is open upwards towards the underside of the hotplate body (2). On either side of the opening of casing (15) located in said top side (17), the casing is provided with spacers (18, 19) in one piece therewith and projecting upwards to different heights for engaging on the associated sloping surface (13) of the underside of hotplate body (2). Thus, in the case of simple manufacture, a good ventilation of casing (15) is obtained.

30 Claims, 2 Drawing Sheets

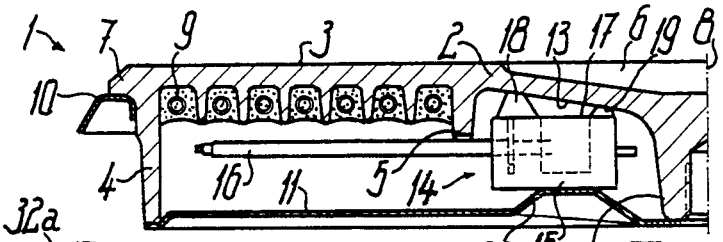
Fig.1
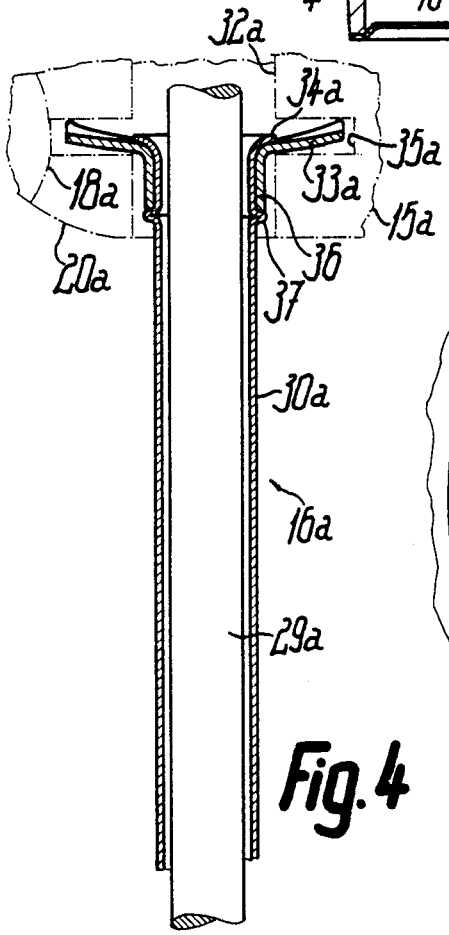
Fig.4
Fig.2
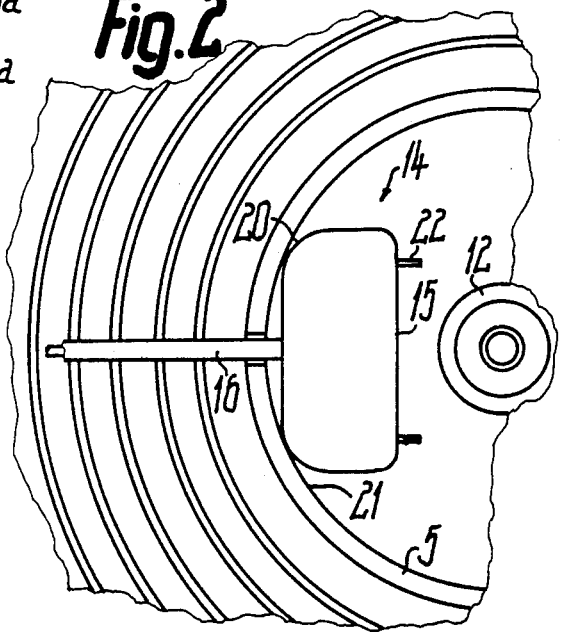
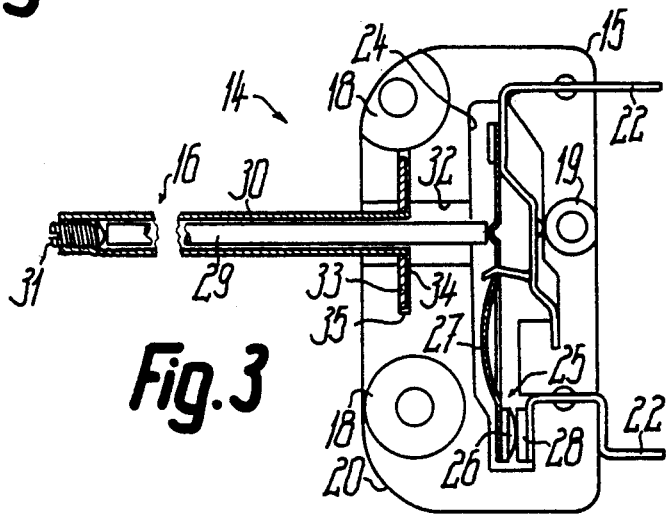
Fig.3

ELECTRIC HOTPLATE

BACKGROUND

The present invention relates to an electric hotplate with a hotplate body which, on its undersurface remote from the cooking surface, is provided with at least one heating resistor embedded in an insulating material and with a thermal cutout, which has a casing located in the central area of the hotplate body with a switch and a rod-like temperature sensor acting thereon and projecting over the casing in the vicinity of the heating resistor.

The casing of the temperature sensor of such electric hotplates serving as a base for the switch part is made from electrically insulating material which, as a result of the very high thermal stresses, must be of very high quality and is usually a ceramic material. This material is difficult to shape and also expensive. Except for the passage of the temperature sensor and connecting lugs, the thermal cutout casing of known electric hotplates is closed and generally the assembly side of the casing is covered with a flat cover, e.g. fixed by means of a rivet. Therefore the live switch parts are reliably covered and advantageous effects are obtained for many applications. However, for other applications this thermal cutout construction is too expensive and the ventilation of the casing too limited. If the casing cover is located on the underside of the casing, in the case of damage the latter can drop onto a cover on the underside of the hotplate body and cause damage.

The problem of the invention is to provide an electric hotplate of the aforementioned type, which ensures improved and simplified manufacture of the thermal cutout.

OBJECTS AND SUMMARY OF THE INVENTION

According to the invention this problem is solved in that the thermal cutout casing is open on its top surface and said open side is arranged in spaced manner below the underside of the hotplate body. Thus, the thermal cutout casing requires no cover, so that it can be constructed continuously and completely in one piece. As its open side is spaced from the hotplate body, it is well ventilated and no moisture can collect in the casing. It also permits a more compact construction of the casing, so that it requires less space.

In order to obtain a precisely defined engagement of the casing on the hotplate body, said casing has spacers, particularly frustum-shaped projections projecting over its top surface and by means of which it engages on the underside of the hotplate body. This also brings about in a surprisingly simple manner a very precise alignment of the relatively long temperature sensor with respect to the hotplate body. In addition, it makes it possible to permit a relatively large open casing region.

With regards to the thermal requirements to be made on the hotplate, it is appropriate if the cross-section of the underside of the hotplate body rises radially outwards in the vicinity of the thermal cutout casing, particularly from a downwardly projecting centre stud to a downwardly projecting inner flanged ring bounding the inner circumference of the heating resistor region. In this case, it is advantageous if at least one spacer located closer to the temperature sensor is higher than at least one spacer more remote therefrom, so that despite the rising bearing face of the hotplate body, it is possible to achieve without particular effort and expenditure an orientation of the casing or temperature sensor parallel to the cooking surface thereof.

A particularly reliable and non-loosening engagement of the thermal cutout casing on the hotplate body can be achieved if, in accordance with a further development of the invention, there are at least three spacers, whereof preferably two are located on either side of the inner end of the temperature sensor and the other roughly in the extension of the temperature sensor. In particular the last-mentioned spacer ensures an exact orientation of the outwardly freely projecting temperature sensor which is appropriately radial with respect to the central axis of the hotplate body and which extends approximately over the entire annular zone in which heating resistors are provided e.g. in spiral grooves surrounding the central axis of the hotplate body and located between the inner flanged ring and an outer, further downwardly projecting flanged ring of the hotplate body.

A much more accurate and stable alignment of the thermal cutout can be achieved in that the thermal cutout casing, engages on the inner circumference of the inner flanged ring of the hotplate body preferably by means of rounded corner regions. Therefore the casing of the thermal cutout is also precisely fixed with respect to the hotplate body in opposition to radial movements. The associated spacers can also be located in said corner regions. A precisely defined engagement of the thermal cutout casing on the inner flanged ring is obtained if the radius of curvature of the particular rounded corner region of the casing is smaller than half of its width measured in the longitudinal direction of the temperature sensor.

A particularly advantageous further development of the invention comprises the open side of the thermal cutout casing being formed by a flat side of the casing and preferably it forms its assembly opening for the switch, particularly a snap switch inserted from this side. Instead thereof and in particular in addition thereto, the open side also forms the assembly opening for the temperature sensor, so that all operating or working parts of the thermal cutout can be fitted by simple insertion from said open side. The arrangement can be such that the fitted parts are essentially only secured through their inherent tension and by the engagement of the movable part of the temperature sensor on the snap switch with respect to the casing.

The inventive construction is particularly suitable for those thermal cutouts, in which the temperature sensor is formed by an outer tube constituting an expansion tube and in inner rod located therein having a different and in particular very small expansion coefficient. The outer tube can be very reliably secured on the casing if a flanged plate with a sleeve shaped thereon is fixed to its inner end, said sleeve preferably surrounding the inner end of the outer tube between an end collar and a squeezed beaded ring. It is also conceivable to provide at least two separate temperature sensors, which are e.g. uniformly distributed about the central axis of the hotplate body or freely project in opposite directions and act on separate switches, said switches being arranged in separate casings or preferably in a common casing traversed by the centre stud of the hotplate body and can also be adjusted to different switching temperatures. The thermal coupling of the thermal cutout to the hotplate can also be improved in the inventive construction.

To further improve the assembly of the thermal cutout and in order to reliably secure the same, the thermal cutout is resiliently pressed against the underside of the hotplate body and preferably a lower hotplate body cover has a spring element, such as a shaped spring shackle or the like engaging on the underside of the thermal cutout casing.

BRIEF DESCRIPTION OF THE DRAWINGS

This and further features of preferred further developments of the invention can be gathered from the description and drawings and individual features can be realize singly or in the form of subcombinations in an embodiment of the invention and in other fields. The invention is described in greater detail hereinafter relative to non-limitative embodiments and the attached drawings, wherein show:

FIG. 1 An inventive electric hotplate in cross-section.

FIG. 2 A detail of FIG. 1 in a view from below.

FIG. 3 The thermal cutout of the electric hotplate according to FIGS. 1 and 2 in plan view.

FIG. 4 Another embodiment of a temperature sensor in axial section.

DETAILED DESCRIPTION OF THE PREFERRED EMBODIMENTS

Figure 5:
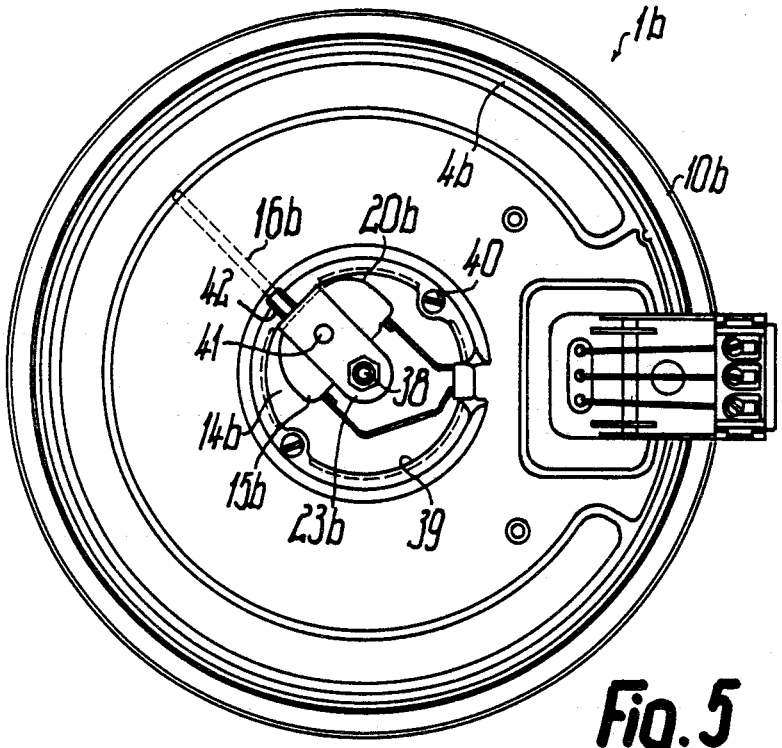
FIG. 5 Another embodiment of an electric hotplate in a view from below.

As shown in FIGS. 1 and 2, an inventive electric hotplate 1 has a cast material and in particular circular hotplate body 2, whose planar top surface centrally provided with a depression 6 forms the cooking surface 3 of hotplate 1 and which is provided on its underside adjacent to a circumferential collar 7 extending roughly up to the cooking surface 3 with an outer flanged ring 4 and in the vicinity of depression 6 with a further inner flanged ring 5 which does not project as far downwards as flanged ring 4. Between the two flanged rings 4, 5 concentric to the central axis 8 of electric hotplate 1 heating resistors 9 are provided on the underside of the hotplate body, which are arranged in grooves spirally curved around central axis 8 and separated from one another by correspondingly spiral webs and are embedded in an insulating material. The inner flanged ring projects over the underside of the spiral webs and therefore the insulating material in a slightly downward direction. On the underside of the circumferential collar 7 is provided a support ring 10 engaging on the outer circumference of flanged ring 4 for supporting electric hotplate 1 on the border of an assembly opening of a hob or the like. The underside of hotplate body 3 is largely closed by a cover 11 in the form of a flat sheet metal cover or the like, said cover 11 engaging on the lower end face of flanged ring 4 and on the underside of a centre stud 12. Centre stud 12 provided in central axis 8 defines with the inner flanged ring 5 an annular space provided within the heating resistors 9 on the underside of hotplate body 2 and with respect to said flanged ring projects further downwards, preferably as far as the outer flanged ring 4. Centre stud 12 is provided with a tapped hole, which secures the hotplate in the hob and cover 11 can be braced against the underside of hotplate body 2. Said annular space is bounded on the top surface by the base wall of depression 6 having a roughly constant thickness and which on the underside forms an annular surface 13 connected by means of a concave fillet to the circumferential surface of centre stud 12 and rising radially outwards under a few radians, e.g. approximately 10° and said surface 13 passes via a corresponding concave fillet into the inner circumferential surface of flanged ring 5.

A thermal cutout 14 is provided in the space between the underside of hotplate body 2 and cover 11. This thermal cutout has a steatite casing 15 located in said annular space and a rod-like temperature sensor 16 projecting freely outwards through said casing and radially with respect to central axis 8. The temperature sensor is at a limited distance below the spiral webs of the hotplate body or the insulating material receiving heating resistors 9 and has a constant spacing therefrom over its length. Temperature sensor 16 extends almost up to the inner circumference of the outer flanged ring 4 and can be arranged in contact-free manner with respect to the inner flanged ring 5. Casing 15 which is elongated-rectangular in plan view and is flatter than wide in side view has its longitudinal extension roughly tangential to the centre stud 12, its upper side 17 parallel to cooking surface 3 or temperature sensor 16 is positioned with a limited spacing below surface 13 of hotplate body 2 in such a way that between said side 17 and surface 13 is formed a gap which widens in cross-section towards flanged ring 5. On its top surface, casing 15 has spacers 18, 19 constructed in one piece therewith and projecting upwards in frustum-shaped manner, which project to varying extents above upper side 17 and with their upper end faces engaged on surface 13 of hotplate body 2. By modifying the position of casing 15 in the longitudinal direction of the temperature sensor 16, it is possible to change or adjust the height position of temperature sensor 16. However, appropriately the arrangement is such that casing 15 with its associated corner regions engages on the inner circumference 21 of the inner flanged ring 5 on either side of temperature sensor 16. In plan view, said corner regions 20 are rounded in quadrant-like manner with a radius of curvature which is smaller than half the edge dimension of casing 15 measured in the longitudinal direction of temperature sensor 16. On the side of casing 15 facing centre stud 12 or remote from temperature sensor 16 it is provided with the electrical connections for thermal cutout 14 in the form of connecting lugs 22, which project over the associated side of casing 15 and are e.g. located on either side of the axial plane of hotplate body 2 passing through temperature sensor 16. On the planar underside of casing 15 parallel to the upper side 17 is provided a spring element 23, which is e.g. formed by a shaped part constructed in one piece with cover 11 and projecting upwards therefrom and which presses casing 15 against surface 13 of hotplate body 2.

As shown in FIG. 3, the casing 15 of thermal cutout 14 is provided with a recess 24 bounded substantially on all sides in plan view for the completely countersunk reception of the switch parts of a snap switch 25 and to whose shape is adapted the recess 24 which is open on its full remaining width on the top side 17. Switch 25 has a snap-action contact 26 carried by a catch spring 27 and with which is associated as an opposite contact 28 a casing-fixed contact. The inner end of an inner rod 29 of the substantially cylindrical rod-shaped temperature sensor 16 acts on a pressure point of catch spring 27. The cylindrical inner rod 29 is arranged with a small radial motion clearance in an outer tube 30 in the form of an expansion tube with a relatively high expansion coefficient, whose inner end is fixed in stable manner to casing 15 and whose free end carries an adjusting member 31 in the form of an adjusting screw and on which is supported the associated outer end of inner rod 29. The inner end of inner rod 29 projects over the inner end of outer tube 30 and is located in a groove extending up to recess 24 in the top side 17 of casing 15. The connecting lug 22 belonging to the snap-action contact 26 is formed by a leg of the contact support, which is inserted in the slot-like depressions of casing 15 from the top side 17 thereof. In the same way, opposite contact 28 with its multiply bent connecting lug 22 is inserted from top side 17 into a slot-shaped opening 15.

Outer tube 30 of temperature sensor 16 has at the inner end an elongated-rectangular flanged plate 33 projecting on all sides over its outer circumference and which is traversed by the outer tube 30 in such a way that the latter engages on the associated side of flanged plate 33 with an outwardly shaped annular collar 34 formed by its end and is fixed thereto. Flanged plate 33 which, in the relaxed state, can be curved in one or two planes, engages with its longer ends in slots 35 of casing 15, which are connected on either side to the lateral faces of groove 32. Flanged plate 33 is secured in these slots by its resilient inherent tension. Adjacent to slots 35, outer tube 33 of temperature sensor 16 is located in substantially contact-free manner in groove 32 in such a way that it projects freely over the associated longitudinal side of casing 15 connecting the rounded corner regions 20.

Two larger diameter and substantially identically large spacers 18 are provided on either side of temperature sensor 16 in the vicinity of in each case one corner region 20. A spacer 18 connected directly to the associated corner region 20 extends roughly up to the adjacent slot 35, whilst the other spacer 18 is essentially located between the adjacent slot 35 and the adjacent corner region 20. The upper end faces of these two spacers 18 are located in a common plane at right angles to temperature sensor 16. The third, much smaller diameter spacer 19 is essentially located in an axial plane of temperature sensor 16 and with respect to spacer 18 on the other side of recess 24 between the connecting lugs 22, so that also said spacer is located outside or immediately adjacent to recess 24.

In the embodiment according to FIG. 4, flanged plate **33*a* has a tubular sleeve 36 constructed in one piece therewith and whose length is only roughly half as large as its diameter and closely surrounds the inner end of outer tube 30*a*. With a spacing from end collar 34*a* adapted to the length of sleeve 36, outer tube 30*a* has an annular collar constructed in one piece therewith projecting over its outer circumference roughly by the wall thickness of sleeve 36 and which is formed by a squeeze beaded ring 37, in whose vicinity the wall of outer tube 30*a* is arranged in double superimposed manner like a U-shaped fold. Against said beaded ring 36 the outer end face of sleeve 36 is braced with end collar 34*a*, so that a very precise and reliable connection is formed. Flanged plate 33*a* is so curved about an axis at right angles to its longitudinal direction that immediately adjacent to sleeve 36 it engages on the boundary edges connected to groove 32*a* of the lateral faces of slots 35*a* positioned closer to the outer end of temperature sensor 16*a*. In addition, at least in the vicinity of its ends, the flanged plate is curved about an axis located at right angles or parallel to its longitudinal direction in such a way that it engages solely by its corner regions on the opposite sides of slots 35*a*. The concave curvature sides of both curvatures are located on the side of flanged plate 33*a* remote from the free end of temperature sensor 16*a* which can be braced by the described construction and under resilient pretension between the lateral surfaces of slots 35*a*. In addition, inner rod 29*a* always engages under pressure on the snap switch, so that the latter is also better fixed in position with respect to casing 15*a*. FIG. 4 also reveals a rounded corner region 20*a* and a spacer 18*a***.

Figure 6:
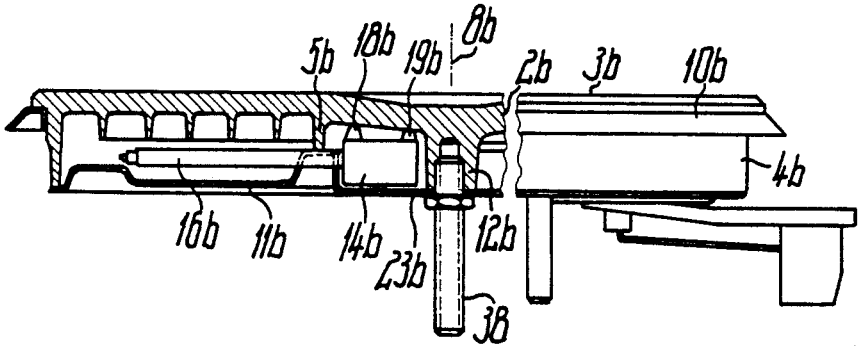
FIG. 6 The electric hotplate according to FIG. 5 in part sectional side view, but without heating resistors.

In FIGS. 5 and 6 corresponding parts are given the same reference numerals as in FIGS. 1 and 2, but are followed by the letter "b". In the embodiment according to FIGS. 5 and 6, it is particularly advantageous that the thermal cutout **14*b*, particularly its switch casing engaging with the spacers 18*b*, 19*b* on the underside of hotplate body 2*b* has a very good ventilation, so that it is possible to completely avoid any heat build-up in the vicinity of the switch casing, whilst the temperature sensor 16*b* is arranged in downwardly well covered manner between cover 11*b* and the underside of hotplate body 2*b*. For this purpose, the cover 11*b* is centrally provided with, in the represented embodiment, an approximately circular opening 39, from whose edge region projects a tongue-like spring element 23*b* constructed in one piece with cover 11*b* and which is approximately radial with respect to the centre stud 12*b*. Said spring element 23*b* only extends up to the centre stud 12*b*, engages on its underside, is traversed by the threaded bolt 38 inserted in centre stud 12*b* and is locked against the underside of the centre stud by a nut screwed onto threaded bolt 38. Spring element 23*b* substantially parallel to the underside of the switch casing of the thermal cutout 14*b*, which has a limited spacing from said underside and located roughly in the plane of the lower end face of the outer flanged ring 4*b* passes at its radially outer end via an approximately rectangular bend into the boundary of opening 39, send bend being directly adjacent to that side of the switch casing from which the temperature sensor 16*b* projects outwards. The width of spring element 23*b* is much smaller than the longitudinal extension of casing 15*b* of thermal cutout 14*b* parallel thereto, said spring element 23*b* being approximately in the centre of said longitudinal extension. Following onto the boundary of opening 39, cover 11*b*, through channel-like pressing in on the underside, forms an approximately closed annular groove about central axis 8*b*, the base wall of said groove being supported on the lower end face of the inner flanged ring 5*b*. In the side walls and base walls of said annular groove is formed a radial slot 42, whose width and depth are the same or only slightly larger than the diameter of temperature sensor 16*b*, so that its relatively short portion connected directly to casing 15*b* can engage in said slot 42 laterally and in height-centred manner. In a view from below, as a result of the described construction the casing 15*b* of thermal cutout 14*b* is solely covered by the spring element 23*b*, whilst being completely exposed on either side of said spring element 23*b* and extending approximately up to the boundary of opening 39. Since in this case an additional securing of cover 11*b* with respect to the hotplate body 2*b* can be appropriate, except in the vicinity of centre stud 12*b*, cover 11*b* is additionally secured with respect to hotplate body 2*b*. For this purpose, immediately adjacent to the boundary of opening 39 are provided two screws 40 diametrically facing one another on either side of spring element 23*b*, which are screwed from below in corresponding tapped holes of lug-like widened portions of the inner flanged ring 5b**.

The clip-like spring element 23b carries between its ends an upwardly projecting cam 41 in the form of a pressed out part, which essentially forms the sole bearing surface for spring element 23b on the underside of casing 15b of thermal cutout 14b. Cam 41 is appropriately located in the vicinity of a button of thermal cutout 14b, so that it presses against the latter and secures the same under resilient pretension. As a result the thermal cutout is reliably pressed against the hotplate body 2b with a reproducible thermal coupling and very simple assembly results.

What is claimed is:

1. An electric hotplate, comprising:

a hotplate body having an underside, a cooking surface on a side opposite to said underside, a central zone and a cover disposed at a space below said underside;

at least one heating resistor being provided on the underside of said hotplate body, said heating resistor being located in a limited region of said hotplate body, said heating resistor being embedded in an insulating material;

a thermal cutout having a casing provided with a top side opposite to an associated surface of the underside of said hotplate body, said casing being located in the central zone of said hotplate body and being provided with a switch and a rodlike temperature sensor acting on said switch, said temperature sensor freely projecting from an inner end over said casing and being disposed at a spaced position from and in the vicinity of said heating resistor;

means for positioning the temperature sensor with respect to the underside of the hotplate body, the improvement comprising:

the top side of said casing of the thermal cutout being an open side arranged in spaced manner below the associated surface of the underside of said hotplate body, and spacers between the open side of the casing and the associated surface of the underside of said hotplate body, said spacers providing the means for positioning the temperature sensor to freely project into the space below said underside of the hotplate body clear of contact with both the hotplate body and the cover.

2. The electric hotplate according to claim 1, wherein the projecting spacers are provided on the top side of said casing of the thermal cutout, said spacers engaging on the underside of said hotplate body, said spacers being frustum-shaped projections.

3. The electric hotplate according to claim 1, wherein said casing, for receiving the inner end of the temperature sensor, has a sensor side remote from a center axis of the hotplate body, said temperature sensor projecting freely over said sensor side, at least three spacers being provided as said spacers, two of said spacers being located on the sensor side on either side of said inner end and a further spacer being located more remote from said temperature sensor towards said center axis.

4. The electric hotplate according to claim 3, wherein in a cross-sectional aspect of the hotplate body, in the vicinity of the casing of said thermal cutout, said underside of the hotplate body rises radially outwards between a downwardly projecting center stud and a downwardly projecting inner flange ring bounding said limited region of the heating resistor on an inner circumference, said two spacers located on the sensor side of said casing being higher than said further spacer and said further spacer being more remote from said temperature sensor as compared with said two spacers.

5. The electric hotplate according to claim 3, wherein at least one spacer is located in a corner region proximate to the sensor side of the casing.

6. The electric hotplate according to claim 5, wherein said spacer has a largest diameter portion in an area connected to said casing, said largest diameter portion being at least as large as a radius of curvature of the proximate rounded corner region of the casing of the thermal cutout.

7. The electric hotplate according to claim 4, wherein the casing of said thermal cutout engages on an inner depending circumferential ridge of the hotplate.

8. The electric hotplate according to claim 7, wherein said inner circumferential ridge is provided by an inner flange ring of said hotplate body.

9. The electric hotplate according to claim 7, wherein the casing of said thermal cutout has rounded corner regions substantially engaging said inner circumferential ridge of said hotplate, said rounded corner regions being determined substantially by a radii of curvature.

10. The electric hotplate according to claim 9, wherein a radius of curvature of said rounded corner region of the casing of said thermal cutout is smaller than half of a casing-width measured in a longitudinal direction of said temperature sensor.

11. The electric hotplate according to claim 1, wherein one of said spacers is located substantially in line with an imaginary longitudinal extension of the temperature sensor.

12. The electric hotplate according to claim 1, wherein the open side of the casing of said thermal cutout is formed by a flat side of said casing.

13. The electric hotplate according to claim 1, wherein the open side of the casing of said thermal cutout forms an assembly opening for the switch inserted from the open side and for the inner end of the temperature sensor inserted from the open side.

14. The electric hotplate according to claim 1, wherein the switch is a snap switch having a snap spring and base elements inserted in slots of said casing.

15. The electric hotplate according to claim 1, wherein the casing of the thermal cutout is resiliently pressed against the underside of the hotplate body.

16. The electric hotplate according to claim 1, wherein the hotplate body is provided with a bottom cover, said bottom cover having a spring element engaging an underside of said casing of the thermal cutout.

17. The electric hotplate according to claim 16, wherein said spring element is formed by a tongue having a width substantially smaller than an extension of said casing in a direction parallel to said width.

18. The electric hotplate according to claim 16, wherein the spring element is provided in one piece with the bottom cover.

19. The electric hotplate according to claim 16, wherein the spring element passes into the bottom cover via a bent portion.

20. The electric hotplate according to claim 16, wherein said spring element only extends up to the center stud of the hotplate body and is fixed with respect to said center stud.

21. The electric hotplate according to claim 16, wherein said spring element engages on the underside of said casing of the thermal cutout by means of an upwardly projecting cam.

22. The electric hotplate according to claim 1, wherein a bottom cover of said hotplate body has at least one ventilation opening for ventilating said casing of the thermal cutout.

23. The electric hotplate according to claim 22, wherein said ventilation opening is defined by a boundary forming a passage in the center of the bottom cover, said bottom cover being fixed directly with respect to the hotplate body adjacent to the boundary of said ventilation opening.

24. The electric hotplate according to claim 22, wherein the spring element projects substantially radially into the ventilation opening, said casing being covered on the underside exclusively by said spring element and being exposed on either side thereof.

25. An electric hotplate, comprising:

a hotplate body having an underside, a cooking surface on a side opposite to said underside and a central zone;

a cover disposed at a space below said underside;

at least one heating resistor being provided on the underside of said hotplate body, said heating resistor being located in a limited region of said hotplate body;

a thermal cutout having a casing provided with an insertion side, said casing being provided with a switch and a rod-like temperature sensor acting on said switch, said temperature sensor freely projecting from an inner end over said casing and being disposed at a spaced position from and in the vicinity of said heating resistor, clear of contact with the hotplate body and the cover, said inner end of the temperature sensor having a flange plate and said casing having slots on the insertion side, said flange plate being insertable into said slots, the improvement comprising said flange plate forming a curved leaf spring.

26. The electric hotplate according to claim 25, wherein the temperature sensor comprises an outer tube constructed as an expansion tube of a predetermined expansion coefficient and an inner rod of a differing expansion coefficient, said inner rod being disposed in said expansion tube, a jacket wall formed by an inner end of said outer tube of the temperature sensor being connected to the flange plate.

27. The electric hotplate according to claim 26, wherein said flange plate has a sleeve shaped on said flange plate in one piece, said sleeve being mounted on the inner end of the outer tube of the temperature sensor, said jacket wall having an end collar and a squeezed beaded ring at a distance from said end collar, said sleeve surrounding the inner end of said outer tube between said end collar and said squeezed beaded ring, said jacket wall being double folded in U-shaped superimposed manner for forming said squeezed beaded ring.

28. The electric hotplate according to claim 25, wherein the flange plate of the temperature sensor is curved about two curvature axes at right angles to one another, said flange plate thereby providing a concave curvature side, a convex curvature side and corner areas projecting on the concave curvature side, said slots of the casing having oppositely facing lateral faces, said flange plate engaging on one hand by its corner areas one of said lateral faces located on the concave curvature side and on the other hand adjacent to the outer tube with its convex curvature side on the other of said lateral faces of the slots of the casing.

29. An electric hotplate comprising:

a hotplate body having an underside, a cooking surface on a side opposite to said underside and a central zone;

a cover disposed at a space below said underside;

at least one heating resistor being provided on the underside of said hotplate body, said heating resistor being located in a limited region of said hotplate body;

a thermal cutout having a casing provided with a top side opposite to an associated surface of the underside of said hotplate body, said casing being provided with a switch and a rod-like temperature sensor acting on said switch, said temperature sensor freely projecting from an inner end over said casing and being disposed at a spaced position from and in the vicinity of said heating resistor, clear of contact with the hotplate body and the cover the improvement comprising means for adjusting the spaced position of the temperature sensor.

30. The electric hotplate according to claim 29, wherein said means for adjusting is provided by a sloping underside of said hotplate body and spacers spanning the top side of said casing and the underside of said hotplate body.

* * * * *